US009394153B2

(12) United States Patent
Goldman et al.

(10) Patent No.: US 9,394,153 B2
(45) **Date of Patent: *Jul. 19, 2016**

(54) MULTIPLE STREAM FILLING SYSTEM

(71) Applicant: The Coca-Cola Company, Atlanta, GA (US)

(72) Inventors: James E. Goldman, Dunwoody, GA (US); James LeSage, Alpharetta, GA (US); Donald E. Gruben, Wheaton, LA (US); Kevin L. Reid, Louisville, KY (US); Jonathan Kirschner, Powder Springs, GA (US); Nilang Patel, Mableton, GA (US)

(73) Assignee: The Coca-Cola Company, Atlanta, GA (US)

( * ) Notice: Subject to any disclaimer, the term of this patent is extended or adjusted under 35 U.S.C. 154(b) by 238 days.

This patent is subject to a terminal disclaimer.

(21) Appl. No.: 13/923,429

(22) Filed: Jun. 21, 2013

(65) Prior Publication Data

US 2014/0373969 A1 Dec. 25, 2014
US 2016/0159502 A9 Jun. 9, 2016

Related U.S. Application Data

(62) Division of application No. 11/686,387, filed on Mar. 15, 2007, now Pat. No. 8,479,784.

(51) Int. Cl.

| | |
|---|---|
| ***B65B 43/42*** | (2006.01) |
| ***B65B 1/36*** | (2006.01) |
| ***B67C 3/00*** | (2006.01) |
| ***B67C 3/20*** | (2006.01) |

(52) U.S. Cl.
CPC ..... *B67C 3/007* (2013.01); *B67C 3/208* (2013.01)

(58) Field of Classification Search
CPC ..... B65B 3/26
USPC ..... 141/9, 100, 103, 129, 130, 144, 145, 141/146, 147, 148
See application file for complete search history.

(56) References Cited

U.S. PATENT DOCUMENTS

| | | | |
|---|---|---|---|
| 574,444 | A | 1/1897 | Nickerson |
| 997,933 | A | 7/1911 | Musso |
| 1,262,880 | A | 4/1918 | Newton |
| 952,903 | A | 3/1920 | Hicks |
| 1,483,861 | A | 2/1924 | Heulings |
| 2,232,273 | A | 2/1941 | Risser |
| 2,353,519 | A | 7/1944 | Spurr |
| 3,172,436 | A | 3/1965 | Wilhere et al. |
| 3,335,767 | A | 8/1967 | Manas |
| 3,349,815 | A | 10/1967 | Baets |
| 3,364,959 | A | 1/1968 | Hamilton et al. |

(Continued)

FOREIGN PATENT DOCUMENTS

| | | |
|---|---|---|
| BE | 901407 | 12/1983 |
| DE | 2516329 A1 | 4/1975 |

(Continued)

*Primary Examiner* — Mark A Laurenzi
*Assistant Examiner* — Andrew Schmid
(74) *Attorney, Agent, or Firm* — Sutherland Asbill & Brennan LLP

(57) ABSTRACT

A filling line for filling a number of containers. The filling line may include a continuous conveyor, one or more micro-ingredient dosers positioned about the continuous conveyor, and one or more macro-ingredient stations positioned along the continuous conveyor.

13 Claims, 3 Drawing Sheets

(56) References Cited

U.S. PATENT DOCUMENTS

| | | | | | |
|---|---|---|---|---|---|
| 3,747,471 | A * | 7/1973 | Duffy | B62D 5/24 91/382 |
| 4,053,003 | A | 10/1977 | Ferrero et al. | |
| 4,154,624 | A * | 5/1979 | Wahl et al. | 134/10 |
| 4,346,122 | A * | 8/1982 | Orthoefer et al. | 426/656 |
| 4,628,974 | A | 12/1986 | Meyer | |
| 4,821,925 | A | 4/1989 | Wiley et al. | |
| 4,871,262 | A | 10/1989 | Krauss et al. | |
| 4,938,387 | A | 7/1990 | Kervefors et al. | |
| 4,941,596 | A | 7/1990 | Marty et al. | |
| 5,000,345 | A | 3/1991 | Brogna et al. | |
| 5,000,351 | A * | 3/1991 | Rudick | 222/105 |
| 5,027,869 | A | 7/1991 | Tsumura et al. | |
| 5,033,254 | A * | 7/1991 | Zenger | 53/431 |
| 5,058,630 | A | 10/1991 | Wiley et al. | |
| 5,083,591 | A | 1/1992 | Edwards et al. | |
| 5,139,056 | A * | 8/1992 | Sagawa et al. | 141/1 |
| 5,168,905 | A * | 12/1992 | Phallen | 141/1 |
| 5,228,594 | A | 7/1993 | Aslin | |
| 5,350,082 | A * | 9/1994 | Kiriakides et al. | 221/1 |
| 5,474,211 | A | 12/1995 | Hellenberg | |
| 5,558,249 | A | 9/1996 | Falcoff | |
| 5,682,745 | A * | 11/1997 | Phillips | B62D 5/06 60/431 |
| 5,707,212 | A | 1/1998 | Matthews | |
| 5,803,320 | A * | 9/1998 | Cutting et al. | 222/641 |
| 5,865,226 | A | 2/1999 | Sweeney | |
| 5,896,899 | A * | 4/1999 | Schmitz | 141/92 |
| 5,896,900 | A * | 4/1999 | Haring et al. | 141/196 |
| 5,931,343 | A | 8/1999 | Topar et al. | |
| 5,950,691 | A * | 9/1999 | Abe et al. | 141/103 |
| 5,996,650 | A | 12/1999 | Phallen et al. | |
| 6,019,851 | A * | 2/2000 | Pittet et al. | 127/2 |
| 6,119,434 | A | 9/2000 | Andersson | |
| 6,170,540 | B1 | 1/2001 | Romero | |
| 6,186,193 | B1 | 2/2001 | Phallen et al. | |
| 6,343,628 | B2 * | 2/2002 | Reinecke | 141/165 |
| 6,394,312 | B1 | 5/2002 | Endou | |
| 6,446,834 | B2 | 9/2002 | Davis et al. | |
| 6,470,922 | B2 * | 10/2002 | Sindermann | 141/37 |
| 6,494,238 | B2 * | 12/2002 | Sindermann | 141/6 |
| 6,523,328 | B1 * | 2/2003 | De Cardenas et al. | 53/399 |
| 6,578,614 | B1 * | 6/2003 | Loewenthal | 156/358 |
| 6,607,013 | B1 | 8/2003 | Leoni | |
| 6,729,361 | B2 * | 5/2004 | Noell | 141/9 |
| 6,742,552 | B2 * | 6/2004 | Raniwala | 141/103 |
| 6,751,525 | B1 | 6/2004 | Crisp, III | |
| 6,761,191 | B2 | 7/2004 | Rosen et al. | |
| 6,766,656 | B1 | 7/2004 | Crisp, III et al. | |
| 6,863,092 | B2 | 3/2005 | Seiver et al. | |
| 6,883,685 | B2 * | 4/2005 | Jones et al. | 222/146.5 |
| 6,918,417 | B2 | 7/2005 | Bernhard | |
| 7,000,656 | B2 | 2/2006 | Todd | |
| 7,077,290 | B2 | 7/2006 | Bethuy et al. | |
| 7,203,572 | B2 | 4/2007 | Crisp, III | |
| 7,223,426 | B2 * | 5/2007 | Cheng et al. | 426/115 |
| 7,243,818 | B2 | 7/2007 | Jones | |
| 7,320,416 | B2 | 1/2008 | Miller et al. | |
| 7,325,485 | B2 | 2/2008 | Carhuff et al. | |
| 7,331,483 | B2 | 2/2008 | Bhimani | |
| 7,337,920 | B2 | 3/2008 | Duck et al. | |
| 7,347,344 | B2 | 3/2008 | Engels et al. | |
| 7,353,080 | B2 | 4/2008 | Walker et al. | |
| 7,597,922 | B2 * | 10/2009 | Cheng et al. | 426/594 |
| 7,757,896 | B2 * | 7/2010 | Carpenter et al. | 222/129.4 |
| 2001/0017815 | A1 | 8/2001 | Ackermann et al. | |
| 2001/0029995 | A1 | 10/2001 | Heller et al. | |
| 2001/0029999 | A1 * | 10/2001 | Reinecke | 141/165 |
| 2001/0045242 | A1 * | 11/2001 | Clusserath et al. | 141/144 |
| 2002/0011277 | A1 | 1/2002 | Castillo | |
| 2002/0073652 | A1 * | 6/2002 | Wiedemann | 53/425 |
| 2002/0139436 | A1 | 10/2002 | Rosen et al. | |
| 2003/0075233 | A1 | 4/2003 | Hewlitt et al. | |
| 2003/0121561 | A1 | 7/2003 | Wagner et al. | |
| 2003/0136461 | A1 | 7/2003 | Lohr | |
| 2003/0150514 | A1 | 8/2003 | DeVillele | |
| 2004/0016475 | A1 * | 1/2004 | Navarro | 141/237 |
| 2004/0089373 | A1 | 5/2004 | Seiver et al. | |
| 2005/0023300 | A1 | 2/2005 | Schultz | |
| 2005/0029287 | A1 | 2/2005 | Mobbs | |
| 2005/0034779 | A1 | 2/2005 | Bernhard | |
| 2005/0092386 | A1 | 5/2005 | Kaufhold et al. | |
| 2005/0100457 | A1 | 5/2005 | Fugere | |
| 2005/0126656 | A1 * | 6/2005 | Wiedemann et al. | 141/144 |
| 2005/0173019 | A1 * | 8/2005 | Navarro | 141/91 |
| 2005/0236429 | A1 | 10/2005 | Duck et al. | |
| 2006/0000851 | A1 | 1/2006 | Girard et al. | |
| 2006/0005896 | A1 * | 1/2006 | Till | 141/147 |
| 2006/0043111 | A1 * | 3/2006 | Jennings et al. | 222/129.1 |
| 2006/0086760 | A1 | 4/2006 | Cohen et al. | |
| 2006/0147313 | A1 | 7/2006 | Zengerle et al. | |
| 2006/0157504 | A1 | 7/2006 | Barker et al. | |
| 2006/0261085 | A1 * | 11/2006 | Halle et al. | 222/54 |
| 2007/0000947 | A1 * | 1/2007 | Lewis et al. | 222/132 |
| 2007/0006939 | A1 * | 1/2007 | Clusserath | 141/40 |
| 2007/0114243 | A1 | 5/2007 | Kershaw et al. | |
| 2007/0148211 | A1 * | 6/2007 | Altreuter et al. | 424/441 |
| 2007/0251260 | A1 | 11/2007 | Baxter et al. | |
| 2007/0255450 | A1 | 11/2007 | Mazur et al. | |
| 2007/0271876 | A1 | 11/2007 | Davies | |
| 2007/0272317 | A1 | 11/2007 | Klopfenstein et al. | |
| 2007/0275125 | A1 | 11/2007 | Catani | |
| 2008/0023488 | A1 | 1/2008 | Guerrero et al. | |
| 2008/0029541 | A1 | 2/2008 | Wallace et al. | |
| 2008/0041876 | A1 | 2/2008 | Frank et al. | |
| 2008/0116262 | A1 | 5/2008 | Majer | |
| 2008/0142548 | A1 | 6/2008 | Moen et al. | |
| 2011/0056708 | A1 * | 3/2011 | Gamble | G05B 11/06 169/14 |
| 2014/0373969 | A1 * | 12/2014 | Goldman et al. | 141/9 |

FOREIGN PATENT DOCUMENTS

| | | | |
|---|---|---|---|
| DE | 4016095 | | 11/1990 |
| EP | 0223643 | A1 | 10/1986 |
| EP | 1132337 | | 9/2001 |
| EP | 1905730 | | 4/2008 |
| EP | 1910095 | | 4/2008 |
| FR | 2615845 | A1 | 12/1988 |
| FR | 2877745 | A1 | 5/2006 |
| GB | 2442223 | | 4/2008 |
| JP | 1199801 | | 8/1989 |
| JP | 2219702 | | 9/1990 |
| JP | 5032292 | | 2/1993 |
| JP | 5223627 | | 8/1993 |
| JP | 6241172 | | 8/1994 |
| JP | 7037575 | | 2/1995 |
| JP | 7096905 | | 4/1995 |
| JP | 7112703 | | 5/1995 |
| JP | 7187102 | | 7/1995 |
| JP | 8285657 | | 1/1996 |
| JP | 10152103 | | 6/1998 |
| JP | 10218103 | | 8/1998 |
| JP | 10305802 | | 11/1998 |
| JP | 2000006907 | | 1/2000 |
| JP | 2000159202 | | 6/2000 |
| JP | 2000168703 | | 6/2000 |
| JP | 2000238703 | | 9/2000 |
| JP | 3078631 | | 7/2001 |
| JP | 2001287703 | | 10/2001 |
| JP | 2002308203 | | 10/2002 |
| JP | 2003175997 | | 6/2003 |
| JP | 2004004053 | | 1/2004 |
| JP | 2004123235 | | 4/2004 |
| JP | 2006206101 | | 8/2005 |
| JP | 3712731 | B2 | 11/2005 |
| JP | 2006051977 | | 2/2006 |
| JP | 3124230 | | 7/2006 |
| WO | 85/04157 | | 9/1985 |
| WO | 8907294 | | 8/1989 |
| WO | 00/58200 | | 10/2000 |
| WO | 0209228 | A2 | 11/2002 |
| WO | 03031265 | | 4/2003 |
| WO | 03054392 | A1 | 7/2003 |

(56) References Cited

FOREIGN PATENT DOCUMENTS

| | | | |
|---|---|---|---|
| WO | 03078935 | A1 | 9/2003 |
| WO | 03097516 | A1 | 11/2003 |
| WO | 2005017356 | A1 | 2/2005 |
| WO | 2005025988 | A2 | 3/2005 |
| WO | 02/057178 | | 8/2005 |
| WO | 2005/070816 | | 8/2005 |
| WO | 2007/070032 | | 6/2007 |
| WO | 2008/015097 | A2 | 2/2008 |

* cited by examiner

MULTIPLE STREAM FILLING SYSTEM

RELATED APPLICATIONS

The present application is a divisional of U.S. Pat. No. 8,479,784, filed on Mar. 15, 2007. U.S. Pat. No. 8,479,784 is incorporated herein by reference in full.

TECHNICAL FIELD

The present application relates generally to high-speed beverage container filling systems and more particularly relates to filling systems that combine streams of concentrate, water, sweetener, and other ingredients as desired at the point of filling a container.

BACKGROUND OF THE INVENTION

Beverage bottles and cans are generally filled with a beverage via a batch process. The beverage components (usually concentrate, sweetener, and water) are mixed in a blending area and then carbonated if desired. The finished beverage product is then pumped to a filler bowl. The containers are filled with the finished beverage product via a filler valve as the containers advance along the filling line. The containers then may be capped, labeled, packaged, and transported to the consumer.

As the number of different beverage products continues to grow, however, bottlers face increasing amounts of downtime because the filling lines need to be changed over from one product to the next. This can be a time consuming process in that the tanks, pipes, and filler bowl must be flushed with water before being refilled with the next product. Bottlers thus are reluctant to produce a small volume of a given product because of the required downtime between production runs.

Not only is there a significant amount of downtime in changing products, the downtime also results when adding various types of ingredients to the product. For example, it may be desirable to add an amount of calcium to an orange juice beverage. Once the run of the orange juice with the calcium is complete, however, the same flushing procedures must be carried out to remove any trace of the calcium. As a result, customized runs of beverages with unique additives simply are not favored given the required downtime.

Thus, there is a desire for an improved high speed filling system that can quickly adapt to filling different types of products as well as products with varying additives. The system preferably can produce these products without downtime or costly changeover procedures. The system also should be able to produce both high volume and customized products in a high speed and efficient manner. There is also a desire to produce a mix of flavors or beverages simultaneously.

SUMMARY OF THE INVENTION

The present application thus describes a filling line for filling a number of containers. The filling line may include a continuous conveyor, one or more micro-ingredient dosers positioned about the continuous conveyor, and one or more macro-ingredient stations positioned along the continuous conveyor.

The micro-ingredient dosers may include one or more micro-ingredient supplies. The micro-ingredient dosers may include a pump in communication with the micro-ingredient supplies. The pump may include a positive displacement pump or a valveless pump. The micro-ingredient dosers may include a servomotor in communication with the pump and a nozzle in communication with the pump. The micro-ingredient dosers may include a flow sensor positioned between the micro-ingredient supplies and the pump. The filling line further may include a dosing sensor positioned downstream of the nozzle. The macro-ingredient stations may include one or more macro-ingredient supplies and one or more diluent supplies.

The containers each may include an identifier thereon and the filling line further may include one or more positioning sensors positioned about the conveyor so as to read the identifier. The identifier identities the nature of a product to be filled within each of the containers.

The nozzle may include a rotary nozzle. The rotary nozzle may include a number of pinwheel nozzles. The conveyor may include one or more dips therein. The conveyor may include a number of grippers positioned about the dips so as to grip the number of containers as they pass through the dips. The micro-ingredient dosers may include a nozzle positioned in a middle of the dips.

The micro-ingredient dosers may include one or more micro-ingredients. The micro-ingredients may include reconstitution ratios of at least about ten to one or higher or about 100 to 1 or higher. The micro-ingredients may include non-sweetened concentrate; acid and non-acid components of non-sweetened concentrate; natural and artificial flavors; flavor additives; natural and artificial colors; artificial sweeteners; additives for controlling tartness, functional additives; nutricuticals; or medicines. The micro-ingredients generally may make up no more than about ten percent (10%) of the container. The macro-ingredient stations may include one or more macro-ingredients. The macro-ingredients may include reconstitution ratios of more than about one to one to less than about ten to one. The macro-ingredients may include sugar syrup, high fructose corn syrup, or juice concentrates. The micro-ingredient dosers may be positioned upstream or downstream of the macro-ingredient stations.

The present application further describes a method of manufacturing a number of products. The method may include positioning one or more micro-ingredient dosers along a conveyor, positioning one or more macro-ingredients stations along the conveyor, instructing a first one of the one or more micro-ingredient dosers to dose a first container with a first micro-ingredient, instructing a second one of the one or more micro-ingredient dosers to dose a second container with a second micro-ingredient, and filling the first container and the second container with a macro-ingredient and a diluent at the macro-ingredient station so as to form a first product and a second product.

The first container may include a first identifier and the second container may include a second identifier. The step of instructing a first one of micro-ingredient dosers to dose a first container with a first micro-ingredient may include reading the first identifier, and the step of instructing a second one of the micro-ingredient dosers to dose a second container with a second micro-ingredient may include reading the second identifier. The method further may include reading a number of identifiers relating to a number of micro-ingredients.

The present application further describes a micro-doser for use with a micro-ingredient. The micro-doser may include a positive displacement pump, a servomotor driving the positive displacement pump, and a nozzle in communication with the pump.

The micro-doser further may include one or more micro-ingredient supplies in communication with the pump. The pump may include a valveless pump. The micro-closer further may include a flow sensor positioned between the micro-ingredient supplies and the pump. The nozzle may include a rotary nozzle. The rotary nozzle may include a number of pinwheel nozzles.

These and other features of the present application will become apparent to one of ordinary skill in the art upon review of the following detailed description when taken in conjunction with the several drawings and the appended claims.

The present application further describes a method of creating a customized beverage in a container. The method includes the steps of positioning a number of stations along a predetermined path, with the stations having one or more customized ingredients, selecting the customized ingredients to create the customized beverage, advancing continuously the container along the predetermined path, and filling the container such that the beverage includes more than ninety percent of base ingredients and a diluent and less than ten percent of the selected customized ingredients.

DETAILED DESCRIPTION

Figure 1:
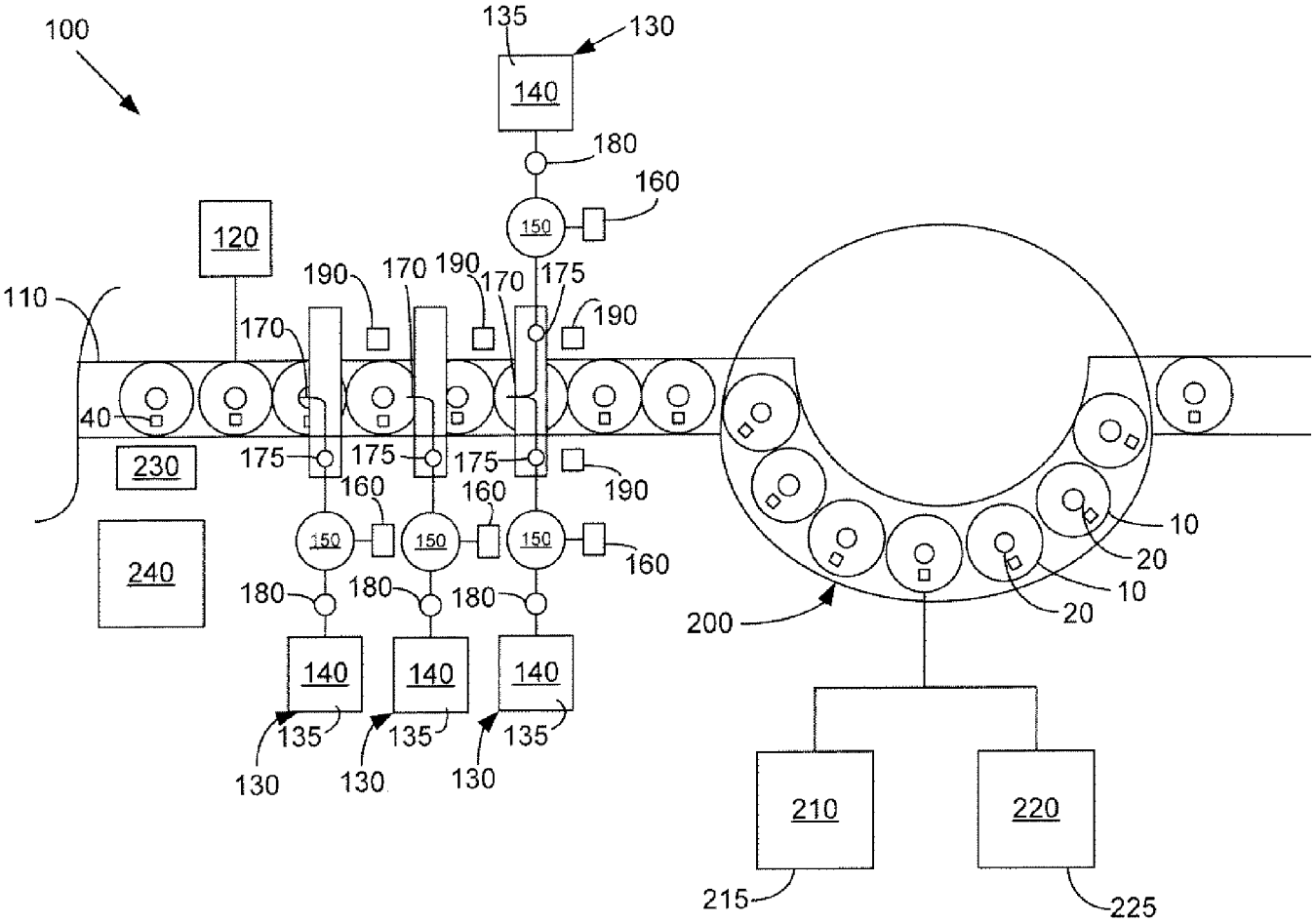
FIG. 1 is a schematic view of a high speed filling line as is described herein.

Generally described, many beverage products include two basic ingredients: water and "syrup". The "syrup" in turn also can be broken down to sweetener and flavoring concentrate. In a carbonated soft drink, for example, water is over eighty percent (80%) of the product, sweetener (natural or artificial) is about fifteen percent (15%), and the remainder is flavoring concentrate. The flavoring and/or coloring concentrate may have reconstitution ratios of about 150 to 1 or more. At such a concentration, there may be about 2.5 grams of concentrated flavoring in a typical twelve (12) ounce beverage.

The beverage thus can be broken down into macro-ingredients, micro-ingredients, and water. The macro-ingredients may have reconstitution ratios in the range of more than about one to one to less than about ten to one and/or make up at least about ninety percent (90%) of a given beverage volume when combined with the diluent regardless of the reconstitution ratios. The macro-ingredients typically have a viscosity of about 100 centipoise or higher. The macro-ingredients may include sugar syrup, HFCS (High Fructose Corn Syrup), juice concentrates, and similar types of fluids. Similarly, a macro-ingredient base product may include sweetener, acid, and other common components. The macro-ingredients may or may not need to be refrigerated.

The micro-ingredients may have reconstitution ratios ranging from at least about ten to one or higher and/or make up no more than about ten percent (10%) of a given beverage volume regardless of the reconstitution ratios. Specifically, many micro-ingredients may be in the range of about 50 to 1 to about 300 to 1 or higher. The viscosity of the micro-ingredients typically ranges from about 1 to about 215 centipoise or so. Examples of micro-ingredients include natural and artificial flavors; flavor additives; natural and artificial colors; artificial sweeteners (high potency or otherwise); additives for controlling tartness, e.g. citric acid, potassium citrate; functional additives such as vitamins, minerals, herbal extracts; nutricuticals; and over the counter (or otherwise) medicines such as acetaminophen and similar types of materials. Likewise, the acid and non-acid components of the non-sweetened concentrate also may be separated and stored individually. The micro-ingredients may be liquid, powder (solid), or gaseous forms and/or combinations thereof. The micro-ingredients may or may not require refrigeration. Non-beverage substances such as paints, dyes, oils, cosmetics, etc. also may be used. Various types of alcohols also may be used as micro or macro-ingredients.

Various methods for combining these micro-ingredients and macro-ingredients are disclosed in commonly owned U.S. patent application Ser. No. 11/276,550, entitled "Beverage Dispensing System"; U.S. patent application Ser. No. 11/276,549, entitled "Juice Dispensing System"; and U.S. patent application Ser. No. 11/276,553, entitled "Methods and Apparatuses For Making Compositions Comprising An Acid and An Acid Degradable Component and/or Compositions Comprising A Plurality of Selectable Components". These patent applications are incorporated herein by reference in full.

The filling devices and methods described hereinafter are intended to fill a number of containers 10 in a high-speed fashion. The containers 10 are shown in the context of conventional beverage bottles. The containers 10, however, also may be in the form of cans, cartons, pouches, cups, buckets, drums, or any other type of liquid carrying device. The nature of the devices and methods described herein is not limited by the nature of the containers 10. Any size or shaped container 10 may be used herein. Likewise, the containers 10 may be made out of any type of conventional material. The containers 10 may be used with beverages and other types of consumable products as well as any nature of nonconsumable products. Each container 10 may have one or more openings 20 of any desired size and a base 30.

Each container may have an identifier 40 such as a barcode, a Snowflake code, color code, RFID tag, or other type of identifying mark positioned thereon. The identifier 40 may be placed on the container 10 before, during, or after filling. If used before filling, the identifier 40 may be used to inform the filling line 100 as to the nature of the ingredients to be filled therein as will be described in more detail below. Any type of identifier or other mark may be used herein.

Referring now to the drawings, in which like numerals refer to like elements throughout the several views, FIG. 1 shows a filling line 100 as is described herein. The filling line 100 may include a conveyor 110 for transporting the containers 10. The conveyor 110 may be a conventional single lane or multi-lane conveyor. The conveyor 110 is capable of both continuous and intermittent motion. The speed of the conveyor 110 may be varied. The conveyor 110 may operate at about 0.42 to about 4.2 feet per second (about 0.125 to about 1.25 meters per second). A conveyor motor 120 may drive the conveyor 110. The conveyor motor 120 may be a standard AC device. Other types of motors include Variable Frequency Drive, servomotors, or similar types of devices. Examples of suitable conveyors 110 include devices manufactured by Sidel of Octeville sur Mer, France under the mark Gebo, by Hartness International of Greenville, S.C. under the mark GripVeyor, and the like. Alternatively, the conveyor 110 may take the form of a star wheel or a series of star wheels. The conveyor 110 may split into any number of individual lanes. The lanes may then recombine or otherwise extend.

The filling line 100 may have a number of filling stations positioned along the conveyor 110. Specifically, a number of micro-ingredient dosers 130 may be used. Each micro-ingredient doser 130 supplies one or more doses of a micro-ingredient 135 as is described above to a container 10. More than one dose may be added to the container 10 depending upon the speed of the container 10 and size of the opening 20 of the container 10.

Each micro-ingredient doser 130 includes one or more micro-ingredient supplies 140. The micro-ingredient supply 140 may be any type of container with a specific micro-ingredient 135 therein. The micro-ingredient supply 140 may or may not be temperature controlled. The micro-ingredient supply 140 may be refillable or replaceable.

Each micro-ingredient doser 130 also may include a pump 150 in fluid communication with the micro-ingredient supply 140. In this example, the pump 150 may be a positive displacement pump. Specifically, the pump 150 may be a valved or valveless pump. Examples includes a valveless pump such as the CeramPump sold by Fluid Metering, Inc. of Syosset, N.Y. or a sanitary split case pump sold by IVEK of North Springfield, Vt. The valveless pump operates via the synchronous rotation and reciprocation of a piston within a chamber such that a specific volume is pumped for every rotation. The flow rate may be adjusted as desired by changing the position of the pump head. Other types of pumping devices such as a piezo electric pump, a pressure/time device, a rotary lobe pump, and similar types of devices may be used herein.

A motor 160 may drive the pump 150. In this example, the motor 160 may be a servomotor. The servomotor 160 may be programmable. An example of a servomotor 160 includes the Allen Bradley line of servomotors sold by Rockwell Automation of Milwaukee, Wis. The servomotor 160 may be variable speed and capable of speeds up to about 5000 rpm. Other types of motors 160 such as stepper motors, Variable Frequency Drive motors, an AC motor, and similar types of devices may be used herein.

Each micro-ingredient doser 130 also may include a nozzle 170. The nozzle 170 is positioned downstream of the pump 150. The nozzle 170 may be positioned about the conveyor 110 so as to dispense a dose of a micro-ingredient 135 into the container 10. The nozzle 170 may be in the form of one or more elongated tubes of various cross-sections with an outlet adjacent to the containers 10 on the conveyor 110. Other types of nozzles 170 such as an orifice plate, an open ended tube, a valved tip, and similar types of devices may be used herein. A check valve 175 may be positioned between the pump 150 and the nozzle 170. The check valve 175 prevents any excess micro-ingredient 135 from passing through the nozzle 170. The micro-ingredients 135 may be dosed sequentially or at the same time. Multiple doses may be provided to each container 10.

Each micro-ingredient doser 130 also may include a flow sensor 180 positioned between the micro-ingredient supply 140 and the pump 150. The flow sensor 180 may be any type of conventional mass flow meter or a similar type of metering device such as a Coriolis meter, conductivity meter, lobe meter, turbine meter or an electromagnetic flow meter. The flow meter 180 provides feedback to ensure that the correct amount of the micro-ingredient 135 from the micro-ingredient supply 140 passes into the pump 150. The flow sensor 180 also detects any drift in the pump 130 such that the operation of the pump 130 may be corrected if out of range.

The conveyor 100 also may include a number of dosing sensors 190 positioned along the conveyor 110 adjacent to each micro-ingredient doser 130. The dosing sensor 190 may be a check weigh scale, a load cell, or a similar type of device. The dosing sensor 190 ensures that the correct amount of each micro-ingredient 135 is in fact dispensed into each container 10 via the micro-ingredient doser 130. Similar types of sensing devices may be used herein. Alternatively or in addition, the conveyor 100 also may include a photo eye, a high-speed camera, a vision system, or a laser inspection system to confirm that the micro-ingredient 135 was dosed from the nozzle 170 at the appropriate time. Further, the coloring of the dose also may be monitored.

The filling line 100 also may include a macro-ingredient station 200. The macro-ingredient station 200 may be upstream or downstream of the micro-ingredient dosers 130 or otherwise positioned along the conveyor 110. The macro-ingredient station 200 may be a conventional non-contact or contact filling device such as those sold by Krones Inc. of Franklin, Wis. under the name Sensometic or by KHS of Waukesha, Wis. under the name Innofill Nev. Other types of filling devices may be used herein. The macro-ingredient station 200 may have a macro-ingredient source 210 with a macro-ingredient 215, such as sweetener (natural or artificial), and a water source 220 with water 225 or other type of diluent. The macro-ingredient station 200 combines a macro-ingredient 215 with the water 225 and dispenses them into a container 10.

One or more macro-ingredient stations 200 may be used herein. For example, one macro-ingredient station 200 may be used with natural sweetener and one macro-ingredient station 200 may be used with artificial sweetener. Similarly, one macro-ingredient station 200 may be used for carbonated beverages and one macro-ingredient station 200 may be used with still or lightly carbonated beverages. Other configurations may be used herein.

The filling line also may include a number of positioning sensors 230 positioned about the conveyor 110. The positioning sensors 230 may be conventional photoelectric devices, high-speed cameras, mechanical contact devices, or similar types of devices. The positioning sensors 230 can read the identifier 40 on each container 10 and/or track the position of each container 10 as it advances along the conveyor 110.

The filling line 100 also may include a controller 240. The controller 240 may be a conventional microprocessor and the like. The controller 240 controls and operates each component of the filling line 100 as has been described above. The controller 240 is programmable.

The conveyor 100 also may include a number of other stations positioned about the conveyor 110. These other stations may include a bottle entry station, a bottle rinse station, a capping station, an agitation station, and a product exit station. Other stations and functions may be used herein as is desired.

In use, the containers 10 are positioned within the filling line 100 and loaded upon the conveyor 110 in a conventional fashion. The containers 10 are then transported via the conveyor 110 pass one or more of the micro-ingredient dosers 130. Depending upon the desired final product, the micro-ingredient dosers 130 may add micro-ingredients 135 such as non-sweetened concentrate, colors, fortifications (health and wellness ingredients), and other types of micro-ingredients 135. The filling line 100 may have any number of micro-ingredient dosers 130. For example, one micro-ingredient doser 130 may have a supply of non-sweetened concentrate for a Coca-Cola® brand carbonated soft drink. Another micro-ingredient doser 130 may have a supply of non-sweetened concentrate for a Sprite® brand carbonated soft drink. Likewise, one micro-ingredient doser 130 may add green coloring for a lime Powerade® brand sports beverage while another micro-ingredient doser 130 may add a purple coloring for a berry beverage. Similarly, various additives also may be added herein. There are no limitations on the nature of the types and combinations of the micro-ingredients 135 that may be added herein. The conveyor 110 may split into any number of lanes such that a number of containers 10 may be co-dosed at the same time. The lanes then may be recombined.

The sensor 230 of the filling line 100 may read the identifier 40 on the container 10 so as to determine the nature of the final product. The controller 240 knows the speed of the conveyor 110 and hence the position of the container 10 on the conveyor 110 at all times. The controller 240 triggers the micro-ingredient doser 130 to deliver a dose of the micro-ingredient 135 into the container 10 as the container 10 passes under the nozzle 170. Specifically, the controller 240 activates the servomotor 160, which in turn activates the pump 150 so as to dispense the correct dose of the micro-ingredient 135 to the nozzle 170 and the container 10. The pump 150 and the motor 160 are capable of quickly firing continuous individual doses of the micro-ingredients 135 such that the conveyor 10 may operate in a continuous fashion without the need to pause about each micro-ingredient doser 130. The flow sensor 180 ensures that the correct dose of micro-ingredient 135 is delivered to the pump 150. Likewise, the dosing sensor 190 downstream of the nozzle 170 ensures that the correct dose was in fact delivered to the container 10.

The containers 10 are then passed to the macro-ingredient station 200 for adding the macro-ingredients 215 and water 225 or other type of diluents. Alternatively, the macro-ingredient station 200 may be upstream of the micro-ingredient dosers 130. Likewise, a number of micro-ingredient dosers 130 may be upstream of the macro-ingredient station 200 and a number of micro-ingredient dosers 130 may be downstream. The container 10 also may be co-dosed. The containers 10 then may be capped and otherwise processed as desired. The filling line 100 thus may fill about 600 to about 800 bottles or more per minute.

The controller 240 may compensate for different types of micro-ingredients 135. For example, each micro-ingredient 135 may have distinct viscosity, volatility, and other flow characteristics. The controller 240 thus can compensate with respect to the pump 150 and the motor 160 so as to accommodate pressure, speed of the pump, trigger time (i.e., distance from the nozzle 170 to the container 10), and acceleration. The dose size also may vary. The typical dose may be about a quarter gram to about 2.5 grams of a micro-ingredient 135 for a twelve (12) ounce container 10 although other sizes may be used herein. The dose may be proportionally different for other sizes.

The filling line 100 thus can produce any number of different products without the usual down time required in known filling systems. As a result, multi-packs may be created as desired with differing products therein. The filling line 100 thus can produce as many different beverages as may be currently on the market without significant downtime.

Figure 2A:
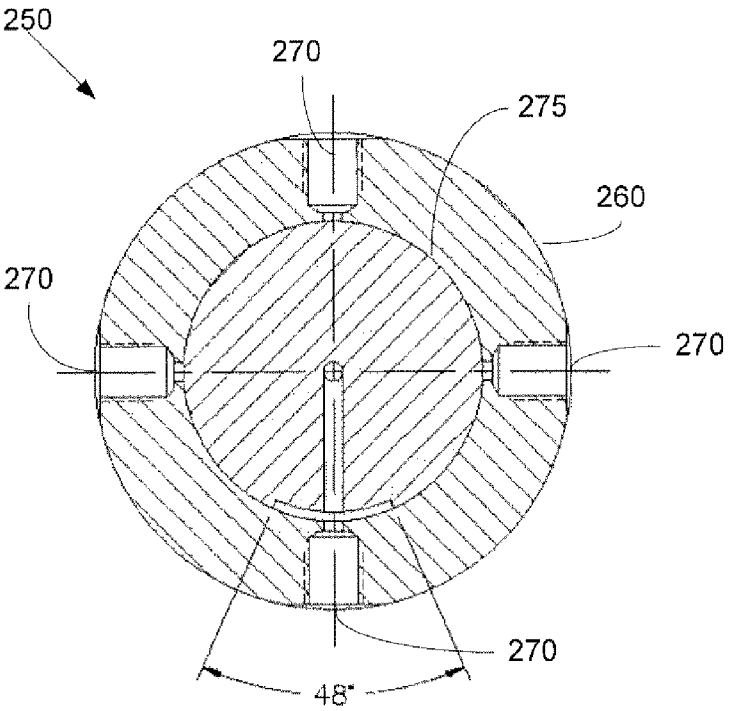
FIG. 2A is a cross-sectional view of a rotary nozzle for use in the alternative embodiment of FIG. 2.
Figure 2:
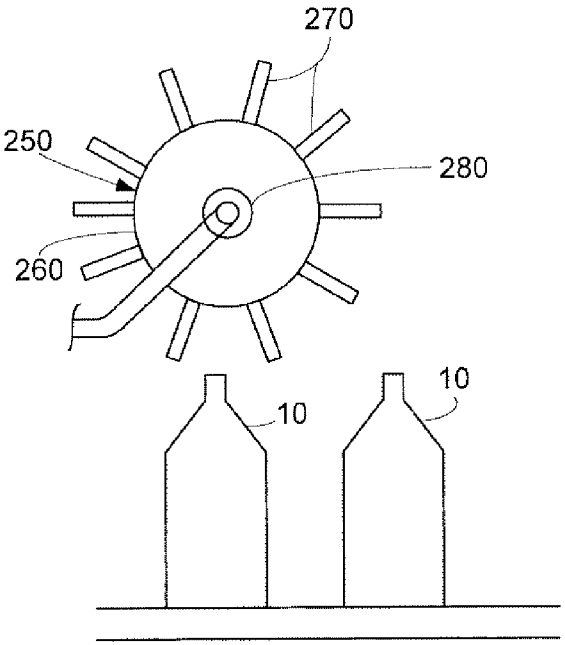
FIG. 2 is a side plan view of an alternative embodiment of a filling nozzle for use in the high speed filling line.

FIGS. 2 and 2A show an alternative embodiment of the nozzle 170 of the micro-ingredient doser 130 described above. This embodiment shows a rotary nozzle 250. The rotary nozzle 250 includes a center drum 260 and a number of pinwheel nozzles 270. As is shown in FIG. 2A, the center drum 260 has a center hub 275. As the pinwheel nozzles 270 rotate about the center drum 260, each nozzle 270 is in communication with the center hub 275 for about 48 degrees or so. The size of the center hub 275 may vary depending upon the desired dwell time. Any size may be used herein.

A motor 280 drives the rotary nozzle 250. The motor 280 may be a conventional AC motor or similar types of drive devices. The motor 280 may be in communication with the controller 240. The motor 280 drives the rotary nozzle 250 such that each of the pinwheel nozzles 270 has sufficient dwell time over the opening 20 of a given container 10. Specifically, each pinwheel nozzle 270 may interface with one of the containers 10 at about the 4 o'clock position and maintain contact through about the 8 o'clock position. By timing the rotation of the pinwheel nozzles 270 and the conveyor 110, each pinwheel nozzle 270 has a dwell time greater than the stationary nozzle 170 by a factor of twelve (12) or so. For example, at a speed of fifty (50) revolutions per minute and a 48-degree center hub 275, each pinwheel nozzle 270 may have a dwell time of about 0.016 over the container 10 as opposed to about 0.05 seconds for the stationary nozzle 170. Such increased dwell time increases the accuracy of the dosing. A number of rotary nozzles 250 may be used together depending upon the number of lanes along the conveyor 110.

Figure 3:
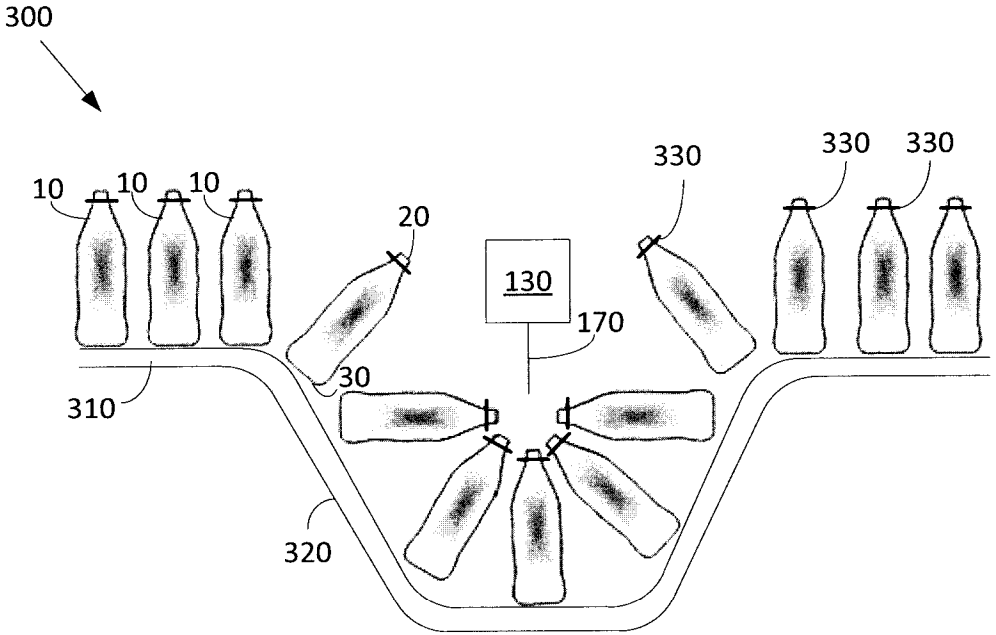
FIG. 3 is a side plan view of an alternative embodiment of a conveyor for use in the high speed filling line.

FIG. 3 shows a further embodiment of a filling line 300. The filling line 300 has a conveyor 310 with one or more U-shaped or semi-circular dips 320 positioned there along. The conveyor 310 also includes a number of grippers 330. The grippers 330 grip each container 110 as it approaches one of the dips 320. The grippers 330 may be a neck grip, a base grip, or similar types of devices. The grippers 330 may be operated by spring loading, cams, or similar types of devices.

The combination of the dips 320 along the conveyor 310 with the grippers 330 causes each container 10 to pivot about the nozzle 170. The nozzle 170 may be positioned roughly in the center of the dip 320. This pivoting causes the opening 20 of the container 10 to accelerate relative to the base 30 of the container 10 that is still moving at the speed of the conveyor 310. As the conveyor 310 curves upward the base 30 continues to move at the speed of the conveyor 310 while the opening 20 has significantly slowed since the arc length traveled by the opening 20 is significantly shorter than the arc length that is traveled by the base 30. The nozzle 170 may be triggered at the bottom of the arc when the container 10 is nearly vertical. The use of the dip 320 thus slows the linear speed of the opening 20 while allowing the nozzle 170 to remain fixed. Specifically, the linear speed slows from being calculated on the basis of packages per minute times finished diameter to packages per minute times major diameter.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. A method of manufacturing a plurality of products, comprising:

positioning a plurality of micro-ingredient dosers along a conveyor;

positioning one or more macro-ingredients stations along the conveyor;

instructing a first one of the plurality of micro-ingredient dosers to dose a first container with a first micro-ingredient;

instructing a second one of the plurality of micro-ingredient dosers to dose separately a second container with a second micro-ingredient;

instructing a third one of the plurality of micro-ingredient dosers to dose separately the first container and/or the second container with a third micro-ingredient; and filling the first container and the second container with a macro-ingredient and a diluent at the one or more macro-ingredient stations so as to form a first product and a second product.

2. The method of manufacturing a plurality of products of claim 1, wherein the first container comprises a first identifier, wherein the second container comprises a second identifier, wherein instructing a first one of the plurality of micro-ingredient dosers to dose a first container with a first micro-ingredient comprises reading the first identifier, and wherein instructing a second one of the plurality of micro-ingredient dosers to dose a second container with a second micro-ingredient comprises reading the second identifier.

3. The method of manufacturing a plurality of products of claim 1, further comprising reading a plurality of identifiers relating to a plurality of micro-ingredients.

4. The method of claim 1, wherein the step of positioning the plurality of micro-ingredient dosers along a conveyor comprises positioning one or more micro-ingredient dosers with micro-ingredients having reconstitution ratios of at least about ten to one or higher.

5. The method of claim 1, wherein the step of positioning the plurality of micro-ingredient dosers along a conveyor comprises positioning one or more micro-ingredient dosers with micro-ingredients having reconstitution ratios of at least about one hundred to one or higher.

6. The method of claim 1, further comprising the step of continuously operating the conveyor without pausing about the first or the second micro-ingredient doser.

7. The method of claim 1, wherein the steps of dispensing a dose comprise activating a positive displacement pump.

8. The method of claim 7, wherein the step of activating a positive displacement pump comprises activating a servomotor.

9. The method of claim 1, wherein the steps of dispensing a dose comprise sensing the dose with a flow sensor.

10. The method of claim 1, further comprising the step of positioning one or more dosing sensors downstream of the one or more micro-ingredient dosers.

11. The method of claim 10, further comprising the steps of weighing the first container and the second container downstream of the one or more micro-ingredient dosers by the one or more dosing sensors.

12. The method of claim 2, wherein the steps of reading the first identifier and the second identifier comprise reading the first identifier and the second identifier with one or more positioning sensors.

13. The method of claim 1, further comprising the step of gripping the first container and the second container along a dip in the conveyor.

* * * * *